US005893401A

United States Patent [19]

Eriksson

[11] Patent Number: 5,893,401

[45] Date of Patent: Apr. 13, 1999

[54] BARKING TOOL

[75] Inventor: Bror Eriksson, Njutånger, Sweden

[73] Assignee: Iggesund Tools AB, Iggesund, Sweden

[21] Appl. No.: 09/025,977

[22] Filed: Feb. 19, 1998

[30] Foreign Application Priority Data

Sep. 4, 1997 [SE] Sweden ..... 9703183

[51] Int. Cl.[6] ..... B27L 1/00

[52] U.S. Cl. ..... 144/208.8; 144/241; 144/341; 407/48; 407/103

[58] Field of Search ..... 407/48, 49, 51, 407/103; 144/208.1, 208.8, 340, 341, 241

[56] References Cited

U.S. PATENT DOCUMENTS

| | | | |
|---|---|---|---|
| 3,026,919 | 3/1962 | Lunn | 144/208.8 |
| 3,282,310 | 11/1966 | Morenius et al. | 144/208.8 |
| 4,122,877 | 10/1978 | Smith et al. | 144/208.8 |
| 4,852,622 | 8/1989 | Eriksson | 144/208.8 |
| 5,460,212 | 10/1995 | Darden et al. | 144/241 |

FOREIGN PATENT DOCUMENTS

WO 92/11119 7/1992 WIPO .

*Primary Examiner*—W. Donald Bray
*Attorney, Agent, or Firm*—Burns, Doane, Swecker & Mathis, L.L.P.

[57] ABSTRACT

The invention concerns a barking tool for barking machines of the type having a plurality of swinging arms, each being at an inner end pivotally mounted on an annular rotator which is rotatable about an axis of rotation, and each having at a free outer end a processing edge. The processing edge is defined between a front and a top surface, which is adapted, during barking, to make an acute angle with the circumferential surface of the log. The barking tool further has a bead, which is located on the top surface in an area adjacent to the end of the processing edge furthest down in the feeding direction. The bead is essentially arcuate in such a manner that its height above the top surface successively increases from an area adjacent to the processing edge perpendicularly backwards therefrom and, more specifically, the height is adapted such that the bead during normal barking is positioned between a certain minimum and a certain maximum, and preferably essentially uniform, distance from the barked circumferential surface of the log independently of its diameter.

20 Claims, 2 Drawing Sheets

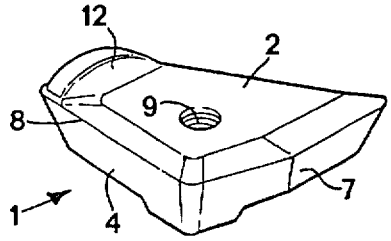
Fig 1
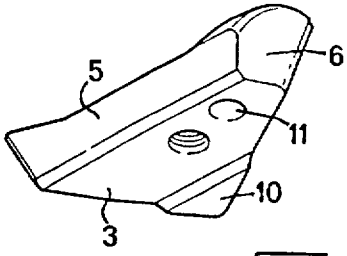
Fig 2
Fig 7
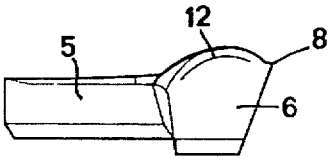
Fig 5
Fig 6
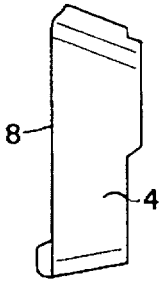
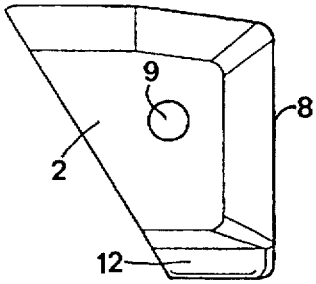
Fig 3
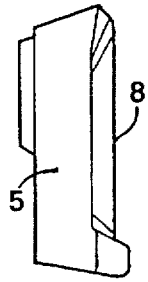
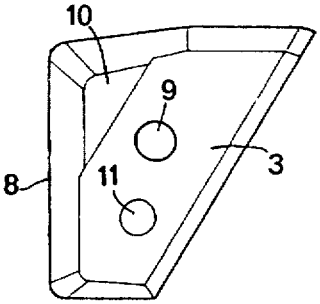
Fig 4
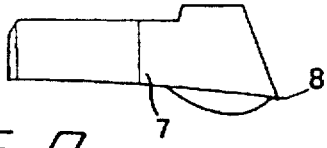
Fig 8

Fig 9
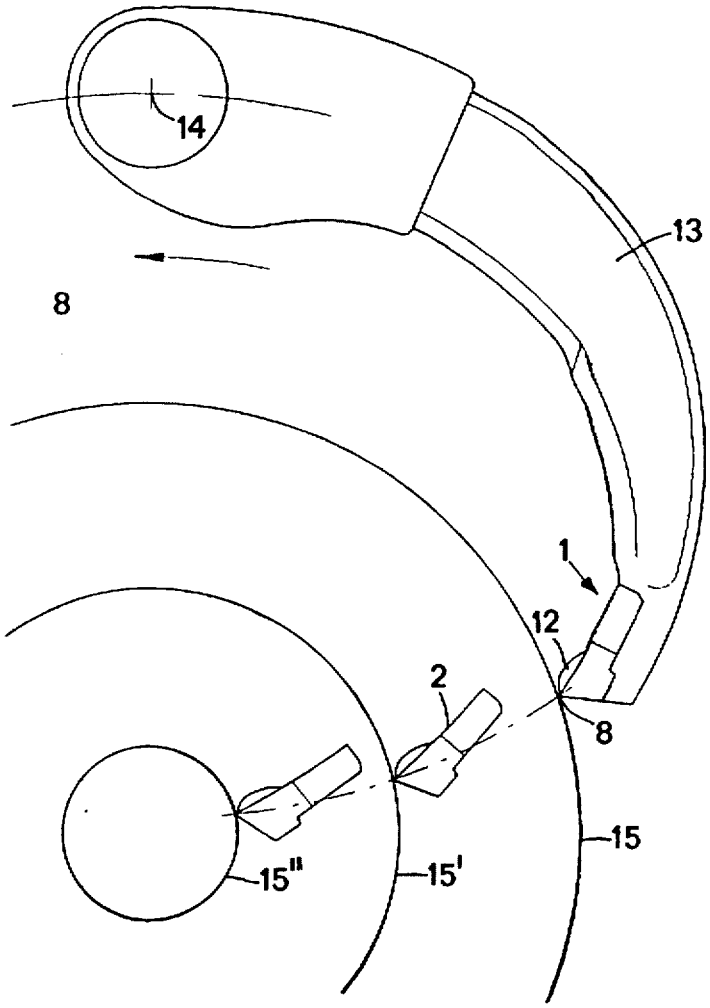
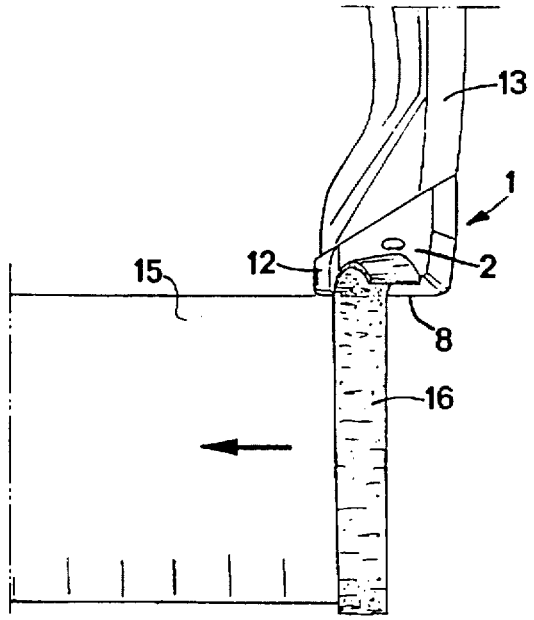
Fig 10

BARKING TOOL

FIELD OF THE INVENTION

The present invention relates to a barking tool for barking machines of the type having a plurality of swinging arms, each being at an inner end pivotally mounted on an annular rotator which is rotatable about an axis of rotation, and each having, at a free outer end, a front edge serving as a processing edge, which is defined between a front and a top surface, which is adapted, during barking, to make an acute angle with the circumferential surface of the log, and a bead which is located on the top surface of the barking tool in an area adjacent to the end of the edge furthest down in the feeding direction, each swinging arm being actuated by a spring load striving to pivot its outer end inwards to the axis of rotation in such a manner that the processing edge is resiliently applicable against the circumferential surface of an unbarked log of wood which is longitudinally fed by the rotator in the direction of the axis of rotation so as to effect shearing of bark from the log during rotation of the rotator.

BACKGROUND ART

Barking machines of the type mentioned by way of introduction have been known for a long time, and as an example reference is made to SE 463,660 which discloses a barking machine, in which the processing edges are formed on separate, exchangeable processing means which are supported at the outer free ends of the respective swinging arms. When a log arrives at the barking machine, the rotation of the rotator, in combination with climb-up edges formed on the swinging arms and designed especially for this purpose, results in the climbing up thereof on the front end surface of the log, such that the outer ends of the swinging arms are pivoted outwards until the edges of the processing means are applied against the circumferential surface of the log. During continued rotation of the rotator and feeding of the log, complete barking of the log is accomplished by the edges of the processing means being resiliently applied against the circumferential surface of the log and shearing off the bark helically along the circumferential surface.

To enable peeling off also of bark which is difficult to remove, such as frozen or dried bark, the force by which the processing edges are resiliently pressed against the log must be relatively great. This causes problems when practically the entire log has been fed through the barking machine and the processing edges are on the way to leave the log. With an unchanged spring load and a smaller and smaller part of the processing edges applied against the circumferential surface, the pressure in the contact surface between log and processing edge will successively increase, resulting in the processing edge cutting deeper and deeper into the log. This causes cuts in the end portion of the log and may in unfavorable cases also result in the log splitting or large pieces being cut away. Such cuts and splits must be cut away from the finished timber, implying that the earnings from the cutaway timber are lost. With optical scanning of the log, the deeper cutting in the end of the log can besides be perceived as a timber defect and result in the log being sawn in a manner which gives a lower timber yield.

The great spring load affecting the swinging arms also causes problems in other areas of a log than precisely adjacent to the rear end portion when the processing edges leave the log. In fact, most logs have knots along their length. When a processing edge hits a knot during the barking process, the swinging arm is thrown away from the circumferential surface, and it is not unusual for the processing edge to move about 5 cm or more away from the log surface. The spring load then provides for the processing edge being again pivoted to the circumferential surface at high speed and with great force. The timber is then damaged by the processing edge making pits which may have a depth of several centimeters. In unfavorable cases, such damage may cause the timber parts which are recovered from the outermost parts of the log cross-sectional area to be classified in a lower class or be rejected, resulting in a reduction of earnings. However, as a rule, the outermost segments of the cross-sectional area of a log are cut to chips for further refinement in the paper industry, but also the quality of the chips is detrimentally affected by all types of chip damage, and therefore many large pits in the circumferential surface may result in the chips being classified in a less paid class of quality. At the same time it is important that the spring load affecting the swinging arms is great such that the barking tools are pivoted back to the surface of the log as quickly as possible and as small areas as possible are left unbarked. The quality of the chips is, in fact, also affected detrimentally by an increasing amount of bark. Summing up, these demands placed on the effecting of the barking process will result in a compromise which is difficult to balance and which, in many cases, does not give a satisfactory result.

SUMMARY OF THE INVENTION

The present invention aims at obviating the above-mentioned problems and drawbacks of barking tools for barking machines of the type mentioned by way of introduction and providing a barking tool which gives an improved barking result and prevents or at least limits the tendency of the processing edge cutting into the wood at the final stage of the barking process when the processing edge is on the way to leave the log, and which limits the tendency of making cut-outs in the surface of the log when the barking tool is pivoted by the spring load back to the barking position after having been thrown outwards owing to irregularities such as knots in the surface of the log. A further object is, while achieving the above-mentioned aims, if so desired, to permit an increase of the spring load affecting the swinging arms. One more aim is that the barking tool should present essentially the same function and effect independently of the diameter of the log. At least these aims are achieved by a barking tool as defined in claim 1.

The invention thus is based on the knowledge that the above-mentioned aims and advantages can be achieved by the barking tool being provided with a bead in the top surface of the barking tool adjacent to that area of the processing edge which is adapted to be located furthest down in the feeding direction of the logs, i.e. in that part of the processing edge which is the last one to leave the logs. It is then ensured that the processing edge penetrates into the bark and the wood to a maximum extent as far as permitted by the bead before this rests against the surface of the log and relieves the pressure of the barking edge against the surface owing to the spring load acting on the swinging arm.

WO 92/11119 discloses a barking tool for barking machines of the type mentioned by way of introduction, which has a bead at its downstream edge. However, the purpose of the bead is not to act as a supporting bead to prevent penetration of the processing edge into the wood like in the present invention. The barking tool could also not be used successfully for this purpose since the bead is positioned at too great a distance from the processing edge. Besides, it extends in an essentially rectilinearly increasing height above the top surface of the barking tool and would then be located at different distances above the circumferential surface of a log depending on the diameter thereof and would consequently give different results and effects for thick and narrow logs, respectively. Instead the purpose of the bead of the barking tool according to this WO publication thus is to act as a deflecting edge which guides the bark away from the rotator. However, when preparing the claims according to the present application, this WO publication has been used as a basis by the preamble to claim 1 accounting for this prior-art barking tool.

The term bead is to be interpreted in its widest sense and comprises all types of formations which can be used as support against the surface of the log. For instance, the bead may be homogeneous and formed integrally with a separate processing means, such as in the preferred embodiment shown and described herein. However, it would also be conceivable, for instance, to make the bead in the form of a relatively thick and suitably designed wire that is fixed to the barking tool by threading or welding, or as a detachable bead which, when needed, can be displaced or exchanged.

In an embodiment of the invention which will be shown and described below, both the processing edge and the bead are arranged on a separate, exchangeable processing means which is fixed to the free outer end of the respective swinging arms. It is, however, within the scope of the invention that the processing edge can be formed directly at the end of the swinging arm and the bead can also be integrated with the swinging arm or formed separately as a bead fixed to the swinging arm. It would also be possible to provide the processing edge on an exchangeable processing means while the bead is arranged on the swinging arm integrated with this or as a separate part. In this case, the bead may be placed in an area beyond the end of the processing edge, which is positioned furthest down in the feeding direction.

In barking machines of the above-mentioned type, the speed of rotation of the rotator and the feeding speed of the logs can be adjusted such that successively arranged barking tools carry out the barking process in helical paths with a certain overlapping relative to each other. By providing the bead along the downstream edge of a processing means or barking tool with a relatively small width and its greatest longitudinal extent essentially perpendicular to the feeding direction of the logs, the bead will, when needed, rest against a part of the log, which has been barked by a preceding barking tool. As a result, the height of the bead need not be adjusted to different thicknesses of bark. However, the bead should not be too narrow if it should be able to act as a relieving supporting surface without cutting into the wood. Preferably, the upper surface or supporting surface of the bead has an extent in parallel with the processing edge of 5–25%, preferably 10–20% of the length of the processing edge, and most preferred about 15%. The invention is, however, not limited to be formed close to the downstream edge of the processing means. For instance, in many cases it may be advantageous for the bead to be formed with a beveled surface on the edge facing the feeding direction. The upper surface or supporting surface of the bead will then be located somewhat upstream relative to the downstream end of the processing edge.

If, instead, the bead is provided on or fixed directly to the swinging arm and is positioned outside the end of the processing edge, which is located furthest down in the feeding direction, the bead will, when necessary, rest against a log surface barked by the preceding barking tool, even if the barking tools bark without any considerable overlapping or with only a minimum amount overlapping in relation to each other.

It is generally preferred for the bead during normal barking to be positioned at a certain minimum distance from the barked log surface to prevent the barking tool from unnecessarily riding on the bead, thereby impairing the barking result. Besides this enables regrinding of the processing edge once or a few times before the bead abuts against the surface of the log during normal barking. The bead can suitably be designed so as to be positioned, during normal barking, about 1 mm from the surface of the log, but in practice this distance can without difficulty be 0–5 mm, preferably 0–2 mm and most preferred 0.5–1.5 mm. However, it is within the scope of the invention that the bead can have such a height and shape as to project slightly in front of the processing edge and that the barking tool rides on the bead during normal barking since also this can give a good barking result for certain types of tree.

In the preferred embodiment, the bead is designed to have the same function and effect independently of whether the diameter of the log is great or small. This means that the height of the bead above the top surface of the barking tool increases with an increasing distance from the processing edge. More specifically, the contour of the bead follows an arcuate curve which conveniently begins about 1 mm behind the processing edge, but which can also be conceived to begin 0–5 mm, preferably 0–2 mm and most preferred 0.5–1.5 mm from the edge. The shape of the bead behind its highest point is fundamentally of no import for its function as a support to prevent the penetration of the processing edge into the wood, but it is generally preferred that the bead has a softly rounded shape preventing it from catching hold of knots and other irregularities when the logs during their longitudinal feeding are displaced in relation to the barking tools. Therefore the bead can suitably in its rear part follow a corresponding or larger arcuate curve as compared with the front part and also be softly rounded in its downstream edge.

BRIEF DESCRIPTION OF THE DRAWINGS

In the drawings,

FIG. 1 is a perspective view, as seen obliquely from above, of a preferred embodiment of a processing means according to the present invention, FIG. 2 is a perspective view, in the diametrically opposed direction, of the processing means according to FIG. 1, seen obliquely from below, FIG. 3 is a top plan view of the processing means according to FIGS. 1 and 2, FIG. 4 is a bottom plan view of the processing means according to FIGS. 1–3, FIGS. 5–8 are side views from the respective sides, from behind and from the front of the processing means according to FIGS. 1–4, FIG. 9 is a schematic side view, seen in the feeding direction of the logs, of a swinging arm with a mounted processing means and the processing means in two alternative positions at different log diameters, and FIG. 10 is a schematic view from above, seen in parallel with the feeding direction of the logs, of a front end of a swinging arm and a processing means during peeling off of the last bark strip from a rear end portion of a log which is longitudinally fed through a barking machine.

DETAILED DESCRIPTION OF A PREFERRED EMBODIMENT OF THE INVENTION

Reference is first made to FIGS. 1–8, which show detailed reproductions of a preferred embodiment of a barking tool according to the present invention, which comprises a separate processing means 1 shown in a perspective view in FIGS. 1 and 2, in a plan view from above and from below in FIGS. 3 and 4, respectively, and in plan views from behind, from the front and from the sides in FIGS. 5–8. The processing means 1 comprises a top surface 2, a bottom surface 3, a front 4, a back 5 as well as a downstream side and an upstream side 6 and 7, respectively. Between the top surface 2 and the front 2 is defined a processing edge 8, which during barking is adapted to be applied against the circumferential surface of a log while shearing bark from the same.

The processing means is adapted to be mounted, by means of a bolt extending through a through hole 9, on the outer free end of a swinging arm, facing with its underside 3 a seat surface of the swinging arm. To ensure non-rotatable holding of the processing means, the underside thereof is provided with a projecting lug 10, which is adapted to engage in a corresponding recess in the seat surface. In order to further increase the security against rotation there is a blind hold 11 for a pin projecting from the seat surface. As is also apparent from the drawings, the upstream side 7 of the processing means is significantly longer than the downstream side 6, and the back 5 extends obliquely in relation to the front 4, which is oriented essentially perpendicular to the upstream and downstream edge. This results in the processing means, seen in a plan view from above or from below, having an almost triangular appearance and being made, on the one hand, for the purpose of saving material and, on the other hand, thereby to obtain greater safety against rotation by the back having a great length and providing a long supporting surface against a corresponding seat edge in the swinging arm. It should, however, be understood that the invention is not limited to a processing means of the type here described, but processing means of many other designs and shapes may be involved.

The upstream side 7 serves as a climb-up edge which enables the swinging arms to climb to the front end surfaces of logs being fed to the barking machine. To provide a soft engagement during climbing, the front portion of the upstream side is slightly inclined and makes an obtuse angle with the processing edge 8.

According to the invention, the processing means is, on its top surface 2, provided with a bead 12 along the downstream side 6. The bead has its largest extent perpendicular to the processing edge 8 and is essentially arcuate or partcircular in this direction, i.e. its height above the top surface 2 varies arcuately with the distance from the processing edge. On the other hand, its extent in parallel with the processing edge is relatively small. In the embodiment shown, the extent of the bead and, to be more precise, its upper surface or supporting surface, is parallel with the processing edge over about 15% of the length of the processing edge. This value may vary, but may in practice be conceived to be 5–25% and preferably about 10–20%. The bead is further designed such that in normal barking, i.e. when barking knot-free logs of essentially circular cross-section, it will be positioned at a certain minimum distance from the circumferential surface of the barked log independently of the diameter of the log. In the embodiment shown, this distance is selected to be about 1 mm, and the bead begins about 1 mm behind the processing edge 8, as is best seen from FIG. 7. From there the bead extends backwards at an angle and with a radius of curvature which are determined by the geometric design of the barking machine, such as the angle at which the processing means are applied against the circumferential surfaces of the logs, the length of the swinging arms and the distance between the center of pivoting of the swinging arms and the axis of rotation of the rotator.

Reference is then made to FIG. 9, which schematically illustrates the positioning of the processing means 1 on the free outer end of a swinging arm 13 whose inner end is pivotally mounted via a pivot axis 14 on an annular rotator (not shown). In practice, the rotator supports a plurality of swinging arms, as a rule five, but in the Figure only one is shown. Further the Figure is seen in the feeding direction of the logs, and at 15, 15', 15" the contours of logs with different diameters are shown schematically. The position of the processing means 1 during barking is drawn at the different diameters, and it is apparent that the angle of the top surface 2 in relation to the circumferential surface of the log increases with a decreasing diameter, while it decreases with an increasing diameter. This is the reason why the bead 12 is designed with an arcuate upper side, and a suitably selected radius of curvature on the front part of the bead ensures that the supporting surface of the bead is located at a certain minimum and a certain maximum, and preferably uniform, distance from the circumferential surface of the log independently of its diameter. The shape of the rear part of the bead can suitably, like in the preferred embodiment, be arcuate and have the same or a larger radius of curvature compared with its front part.

FIG. 10 illustrates one of the situations, in which the advantages of the present invention are obvious. The Figure is a view taken perpendicular to the feeding direction of the logs and shows a rear end of a log 15 and the outer end of a swinging arm 13 provided with a processing means 1 which is directed with its top surface 2 obliquely towards the log and the viewer, the processing edge 8 being applied against the circumferential surface of the log while peeling off a last narrow bark strip 16 from the log. In this position, the log is almost completely fed through the barking machine, and the processing means is on the way to leave the log and already has about half the processing edge 8 outside the end surface of the log. With the swinging arm subjected to an unchanged spring load, the load will be distributed to the log via an increasingly smaller length of the processing edge 8, thereby increasing the pressure of the barking edge against the circumferential surface and, thus, also the risk that the processing edge cuts into the wood. By the bead 12 being arranged furthest down at the downstream side of the processing means, this will be the last to leave the log and thereby limits the penetration of the processing edge to one or a few millimeters before the bead abuts against the surface of the log and carries the spring load acting on the swinging arm. FIG. 10 shows only one swinging arm, but it should be understood that the barking machine comprises a plurality of swinging arms distributed along the circumference of the rotator, each barking the log in helical paths. With a view to ensuring a good barking result, the paths overlap each other to some extent and, as illustrated in FIG. 10, thanks to the bead being arranged adjacent to the downstream side and having a relatively small extent in parallel with the processing edge, the bead will follow the log along a helical path which is already barked by the preceding swinging arm and processing edge.

What I claim and desire to secure by Letters Patent is:

1. A barking tool for a barking machine, the barking machine having a plurality of swinging arms and an annular rotator, the rotator being rotatable about an axis of rotation, each swinging arm having an inner end and an outer end and being, at the inner end, pivotally mounted on the annular rotator, and each arm having a free outer end, the barking tool being disposed at the free outer end of each swinging arm, the machine including a spring load, each swinging arm being actuated by the spring load such that the outer end is urged inwardly toward the axis of rotation to cause the barking tool to be urged against a circumferential surface of a log being barked, the barking tool comprising:

a processing edge, the processing edge having a first end and a second end, and a direction from the second end to the first end defining a feeding direction of the barking tool;

a front surface and a top surface, the front surface and the top surface defining the processing edge, the top surface defining, during barking, an acute angle with a circumferential surface of a log being barked; and a bead, the bead being disposed on the top surface proximate the first end of the processing edge, the bead being substantially arcuate such that a height of the bead above the top surface increases from an area substantially adjacent to the processing edge to an area removed from the processing edge.

2. A barking tool as claimed in claim 1, wherein the barking tool is formed such that a distance between the bead and a barked circumferential surface of the log is 0–5 mm.

3. A barking tool as claimed in claim 1, wherein the bead begins at a distance of 0–2 mm from the processing edge.

4. A barking tool as claimed in claim 1, wherein an upper surface of the bead includes a portion that is parallel with the processing edge and that is 5–25% of the length of the processing edge.

5. A barking tool as claimed in claim 1, wherein the barking tool is removably attachable to the free outer end of the swinging arm.

6. A barking tool as claimed in claim 2, wherein the bead begins at a distance of 0–2 mm from the processing edge.

7. A barking tool as claimed in claim 2, wherein an upper surface of the bead includes a portion that is parallel with the processing edge and that is 5–25% of the length of the processing edge.

8. A barking tool as claimed in claim 3, wherein an upper surface of the bead includes a portion that is parallel with the processing edge and that is 5–25% of the length of the processing edge.

9. A barking tool as claimed in claim 6, wherein an upper surface of the bead includes a portion that is parallel with the processing edge and that is 5–25% of the length of the processing edge.

10. A barking tool as claimed in claim 2, wherein the barking tool is removably attachable to the free outer end of the swinging arm.

11. A barking tool as claimed in claim 3, wherein the barking tool is removably attachable to the free outer end of the swinging arm.

12. A barking tool as claimed in claim 4, wherein the barking tool is removably attachable to the free outer end of the swinging arm.

13. A barking tool as claimed in claim 6, wherein the barking tool is removably attachable to the free outer end of the swinging arm.

14. A barking tool as claimed in claim 7, wherein the barking tool is removably attachable to the free outer end of the swinging arm.

15. A barking tool as claimed in claim 8, wherein the barking tool is removably attachable to the free outer end of the swinging arm.

16. A barking tool as claimed in claim 9, wherein the barking tool is removably attachable to the free outer end of the swinging arm.

17. A barking tool, comprising:

a processing edge;

a front surface and a top surface, the front surface and the top surface defining the processing edge; and a bead, the bead being substantially arcuate such that a height of the bead above the top surface increases from an area substantially adjacent to the processing edge to an area removed from the processing edge.

18. A barking tool as claimed in claim 17, wherein the processing edge has a first end and a second end, the bead being disposed on the top surface proximate the first end of the processing edge.

19. A barking tool as claimed in claim 17, wherein the bead begins at a distance of 0–2 mm from the processing edge.

20. A barking tool as claimed in claim 17, wherein an upper surface of the bead includes a portion that is parallel with the processing edge and that is 5–25% of the length of the processing edge.

* * * * *